United States Patent [19]

Fritsch

[11] Patent Number: 4,474,132

[45] Date of Patent: Oct. 2, 1984

[54] PENNANT SUPPORT

[76] Inventor: Robert C. Fritsch, 21 Pompano Dr., New Port Richey, Fla. 33552

[21] Appl. No.: 363,640

[22] Filed: Mar. 30, 1982

[51] Int. Cl.[3] ..... G09F 17/00

[52] U.S. Cl. ..... 116/173; 52/148

[58] Field of Search ..... 116/173, 174; 73/188; 248/231.8; 24/255 BS, 255 SC, 256; 52/148

[56] References Cited

U.S. PATENT DOCUMENTS

| | | | |
|---|---|---|---|
| 632,580 | 9/1899 | Macartney | 116/174 |
| 2,369,518 | 2/1945 | Ballard | 116/174 |
| 2,672,118 | 3/1954 | Martin | 116/174 |
| 3,395,577 | 8/1968 | Keim | 116/174 |
| 4,115,966 | 9/1978 | DeLee | 52/148 |

*Primary Examiner*—S. Clement Swisher
*Assistant Examiner*—Hezron E. Williams
*Attorney, Agent, or Firm*—Duckworth, Allen, Dyer, & Pettis

[57] ABSTRACT

A support device suitable for flying a pennant, flag or burgee from an elongated support element. The pennant support of this invention is characterized by its provision of elements for removably attaching the pennant support to the support element in a fashion whereby the pennant support is free to pivot, or rotate, about the support element. Thus, when a pennant, flag or burgee is connected to the pennant support there is virtually no chance of the connected indicia becoming tangled or twisted around the support element. Alternative embodiments of the pennant support are also disclosed whereby it may be used for attaching such indicia to shrouds, stays or halyards as the support element so that the indicia may be raised and lowered with respect to the support element.

12 Claims, 14 Drawing Figures

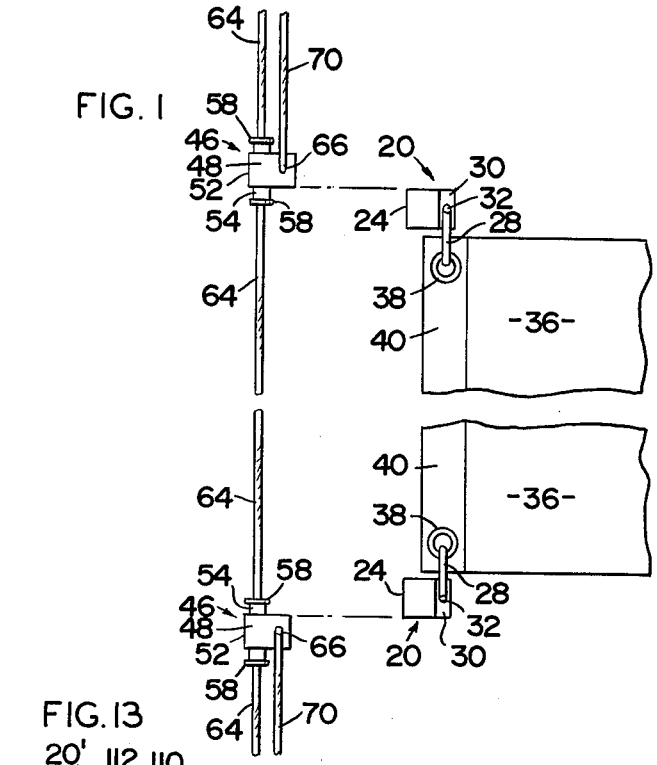
FIG. 1
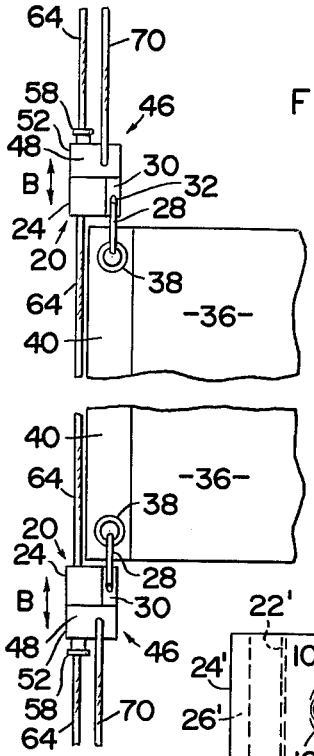
FIG. 2
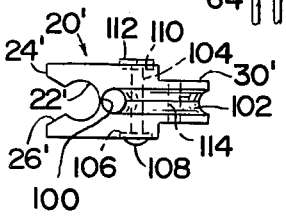
FIG. 13
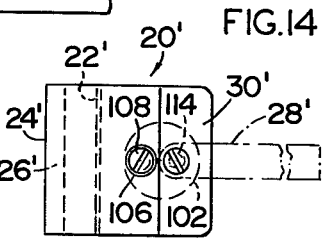
FIG. 14
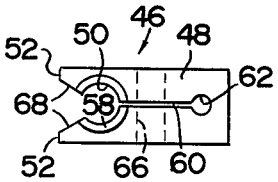
FIG. 3
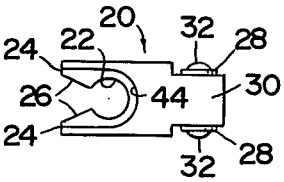
FIG. 6
FIG. 4
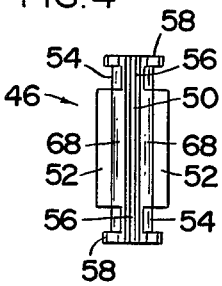
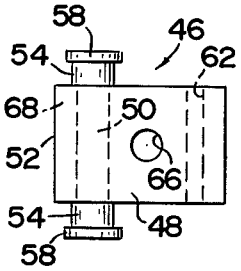
FIG. 5
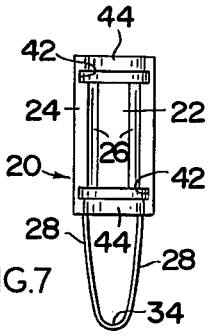
FIG. 7
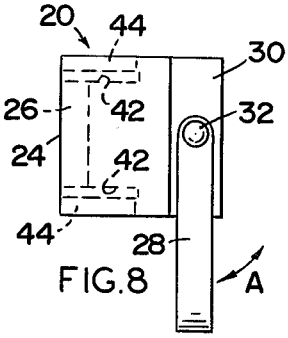
FIG. 8
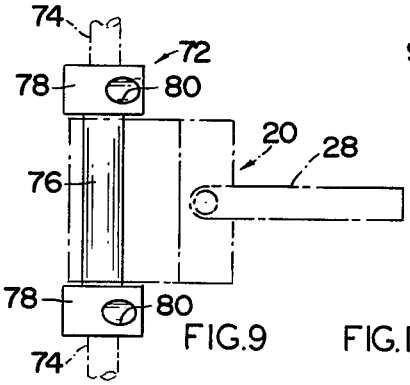
FIG. 9
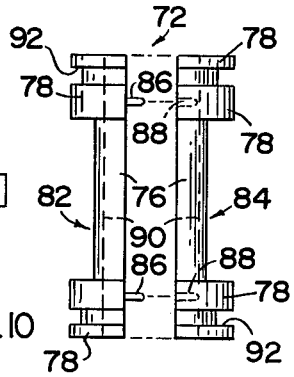
FIG. 10
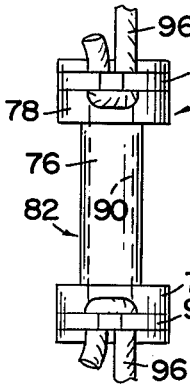
FIG. 11
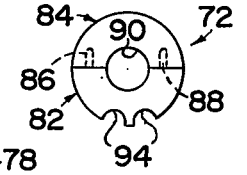
FIG. 12

PENNANT SUPPORT

BACKGROUND OF THE INVENTION

1. Field of the Invention

The present invention relates generally to pennant supports of the type utilized for displaying various indicia such as, for example, pennants, flags or burgees (hereinafter collectively referred to as pennants), on an elongated support element in a fashion substantially eliminating any chance of the indicia becoming twisted or tangled about the support element.

2. Description of the Prior Art

Many pennant supports are known in the prior art, and a great variety of such supports have been the subject matter of issued United States Letters Patent. A well-recognized problem with regard to pennant supports involves some means of displaying the pennant while, at the same time, preventing the pennant from becoming twisted around its support element. In attempts to solve this problem flag hoist devices generally referred to as anti-fouling assemblies have been developed. U.S. Pat. No. 1,855,824 (Chrichton) and U.S. Pat. No. 2,711,712 (Reed) are two examples of such assemblies. The Chrichton patent is a flag staff wherein the flag is connected to the staff through a rigid support member including bearings whereby the entire support may rotate about the staff. The patent to Reed especially recognizes the fact that pennants are not conveniently flown from halyards because of the "inevitable tangling of the flags in the halyards and around the staff." His solution to this problem comprises a continuously rotatable flag support to which the flag is attached and which prevents tangling by slipping the entire flag support over the distal end of the staff. While this is certainly an adequate solution when one wishes to fly a pennant from a fixed staff, the Reed construction really does not address the problem of a pennant's becoming tangled around a halyard.

Other exemplary supports are presented in U.S. Pat. No. 2,905,140 (Acklam) and U.S. Pat. No. 3,075,492 (Winfrey). The device of Acklam does permit the pennant to rotate about its support element, but installation of the support is accomplished by slipping the entire support means over a free end of the staff. This device would not be suitable for displaying a pennant on a continuous line such as, for example, a stay, shroud or halyard. While the device of Winfrey could be clipped onto a continuous line, because of the positive engagement between the support means and the support element, the pennant would probably become tangled therearound.

U.S. Pat. No. 632,580 (Macartney) and U.S. Pat. No. 2,976,382 (Schmit) both disclose means for flying a flag from a rigid staff. A similar disclosure with regard to displaying signs or for constructing various structural systems is present in U.S. Pat. No. 4,115,966 (DeLee). Finally, though not specifically concerned with displaying pennants, the prior art teachings of U.S. Pat. No. 3,395,577 and U.S. Pat. No. 3,815,412 (both to Keim) are worthy of note. Both of these patents teach means for attaching a wind direction indicator to a boat's shroud. However, because these patents are concerned with wind direction indicators, no means are disclosed for raising and lowering the indicia with respect to its support element.

Accordingly, it is clear that there is a great need in the art for a pennant support of the type particularly suitable for displaying pennants on continuous lines such as shrouds, stays and halyards found on ships and boats whereby the pennant may not only be raised and lowered, but also be supported in a fashion that will substantially eliminate any chance of its becoming tangled around the support element. While an acceptable pennant support must satisfy the two conditions just stated above, it would also be desirable if means were also included for raising and lowering the pennant with respect to the support element or the pennant support itself.

SUMMARY OF THE INVENTION

The present invention relates to a pennant support of the type primarily intended for removably connecting a pennant to an elongated support element. While there is no intention of limiting the scope of this invention thereto, the pennant support of this invention is particularly suited for displaying pennants from a ship or boat from its shrouds, stays or halyards. It should also be noted that while the pennant support of this invention will hereinafter be described and referred to in the singular, supports will generally be utilized in pairs since most pennants are of a size requiring at least two means for connecting the pennant to its support element. Accordingly, a single pennant support might be utilized when flying, for example, a homeward bound pennant; a pair of pennant supports would be utilized for most instances; and more than two pennant supports might be necessary for displaying unusually large pennants.

The pennant support of this invention basically comprises a pennant clip means including a support receiving means comprising an elongated, concave groove formed along a first side thereof. The inside diameter of this groove is dimensioned and configured to snap around the support element such as, for example, a stay. While there is no intention to limit the size of the groove's inside diameter, it is preferably slightly larger than the outside diameter of the support element so that the clip means may pivot, or rotate, therearound. As will be explained in greater detail below, this construction effectively precludes any chance of the pennant's becoming tangled around the stay. A strap means is movably attached to the second side of the clip means in a fashion to define a closed loop, and this loop is actually utilized for connecting the pennant to the clip means. The strap means is movable throughout an angle of about 180° so that the closed loop may be oriented toward the grommet normally provided on the pennant for affecting its display.

In another embodiment of the pennant support of this invention, it further comprises a halyard runner means movably disposed in substantially surrounding relation to the support element. As will be explained in greater detail below, the halyard runner means is preferably formed from first and second mating halves releasably attachable to each other so that the halyard runner means may be operatively installed for a continuous support element such as a halyard. The halyard runner means comprises an elongated hollow body having a shoulder formed at each end thereof. A line aperture is formed through each of the shoulders so that a line may be attached to at least one end of the halyard runner in order to raise and lower it along the support element. In this embodiment, the pennant clip means is not attached to the support element per se, rather it is connected thereto by clipping the pennant clip means around the outside surface of the halyard runner's elongated hollow body. The outside diameter of the hollow body is slightly less than the inside diameter of the groove, so the pennant clip means is free to rotate therearound, again substantially eliminating the chance of the pennant's tangling.

In yet another embodiment the pennant support of this invention further comprises a shroud runner means movably disposed in at least partially surrounding relation on a segment of the support element such as, for example, a shroud. In similar fashion to the pennant clip means, the shroud runner means comprises a body having an elongated concavity formed along a first side thereof. A tubular segment congruent with the concavity extends from the body at each end of the concavity, and an outwardly extending transverse lip is formed on the distal end of each tubular segment. In this embodiment the pennant clip means further comprises a lip receiver integrally formed at each end of its elongated groove in receiving relation to one of the lips formed on the shroud runner. The shroud runner further comprises a line aperture formed through its body whereby a line may be attached thereto to raise and lower the shroud runner along the support element. As with the embodiment comprising the halyard runner means, in this embodiment the pennant clip means does not attach directly to the support element. Rather, it snaps onto the shroud runner with one of the shroud's lips being received by a corresponding one of the pennant clip's lip receivers.

The inside diameter of the shroud runner concavity and each of its congruent tubular segments is greater than the diameter of the support element to permit movement of the shroud runner therealong. The outside diameters of both the tubular segments and the lips formed thereon are slightly less than the inside diameter of the lip receivers formed on the pennant clip means in order to permit the pennant clip means to pivot therearound. Again, by virtue of the construction of both the pennant clip and the shroud runner, this embodiment of the pennant support may be conveniently mounted along a continuous line, may be raised or lowered with respect to that line, and substantially eliminate any possibility of the pennant's becoming tangled about the line.

In yet another embodiment of the pennant support of this invention the pennant connecting means disposed on the second side of the pennant clip means comprises a pennant line aperture formed through the clip means in substantially parallel relation to the support receiving means. The pennant connecting means further comprises a substantially circular guide surface which intersects the pennant line aperture and at least a portion of the second side of the clip means. In effect, then, the circular guide surface functions in the nature of a fixed pulley around which a pennant line may pass to permit raising and lowering of a pennant attached to that line with respect to the clip means.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is an exploded view of one embodiment of the pennant support showing a pair of clip means attached to a pennant for operative engagement with a corresponding pair of shroud runner means.

FIG. 2 depicts the embodiment of FIG. 1 in its assembled, operative form.

FIG. 3 is a top plan view of the shroud runner means.

FIG. 4 is an elevational view of the first side of the shroud runner means.

FIG. 5 is a side elevation view of the shroud runner means.

FIG. 6 is a top plan view of the pennant clip means illustrated in FIGS. 1 and 2.

FIG. 7 is an elevational view of the first side of the pennant clip means of FIG. 6.

FIG. 8 is a side elevational view of the pennant clip means of FIG. 6.

FIG. 9 is an elevational view of one embodiment of the halyard runner means with the pennant clip means shown in phantom.

FIG. 10 is an exploded elevational view of another embodiment of the halyard runner means.

FIG. 11 is an elevational view of the assembled halyard runner means of FIG. 10.

FIG. 12 is a top plan view of the assembled halyard runner means of FIG. 10.

FIG. 13 is a top plan view of another embodiment of the pennant clip means.

FIG. 14 is a side elevational view of the pennant clip means depicted in FIG. 13, with the strap means shown in phantom.

Similar reference characters refer to similar parts throughout the several views of the drawings.

DETAILED DESCRIPTION

Attention is first invited to the views of FIGS. 6, 7 and 8 wherein a first embodiment of the pennant clip means, generally indicated at 20, is depicted. At these figures illustrate, pennant clip means 20 comprises a support receiving means defined by an elongated groove 22 formed along a first side 24 of the clip means 20. As best seen in the plan view of FIG. 6, elongated groove 22 is open adjacent first side 24, but the relative size of the opening increases as first side 24 is approached by virtue of integral wedges 26. This construction permits operative attachment of the clip means 20 to a support element (not shown) such as, for example, a boat's backstay. Clip means 20 would be snapped onto the backstay so that the stay was contained within elongated groove 22. Accordingly, the internal diameter of groove 22 is determined with respect to the outside diameter of the support element to which it will be attached. Still with regard to the views of FIGS. 6, 7 and 8, it can be seen that clip means 20 further comprises pennant connecting means defined by a strap means 28 movably attached to second side 30 of clip means 20. Strap means 28 may be attached as by fastening means 32 to define a closed loop 34 whereby a flag 36 may be connected to the clip means 20 as shown in the view of FIG. 1. With particular regard to the view of FIG. 8, it can be seen that strap means 28 may pivot about the fastening means 32 as indicated by directional arrow A in order to position closed loop 34 substantially adjacent grommet 38 mounted in hem portion 40 of flag 36. Actual attachment of the clip means 20 to the flag 36 may be accomplished as by removing fastening means 32 to permit a free end of strap means 28 to pass through grommet 38, and then replacing the fastening means 32.

In this embodiment of pennant clip means 20, and as best seen in the views of FIGS. 7 and 8, elongated groove 22 further comprises a lip receiver 42 integrally formed at each end of groove 22. Immediately outboard each of the lip receivers 42, the absence of wedges 26 should be noted with the result being an enlarged slot 44 communicating with each of the lip receivers 42 and each distal end of groove 22. The function and utility of lip receivers 42 and enlarged slots 44 will be set forth hereinafter.

Having thus described one embodiment for the pennant clip means 20 of this invention, and while this embodiment may be utilized for operatively displaying a flag 36 on virtually any elongated support element dimensioned for reception within elongated groove 22, attention is now invited to the views of FIGS. 1–5 for a detailed description of another embodiment of the pennant support of this invention wherein clip means 20 is utilized in combination with a shroud runner means generally indicated as 46. Shroud runner means 46 comprises a body 48 having an elongated concavity 50 formed along a first side 52 of body 48. A tubular segment 54, the interior 56 of which is congruent with concavity 50 extends from body 48 at each end of concavity 50. An outwardly extending transverse lip 58 is formed on the distal end of each of the tubular segments 54. As best seen in the plan view of FIG. 3, shroud runner means 46 further comprises a slot 60 formed through body 48, and one end of slot 60 intersects concavity 50. The other end of slot 60 defines an enlarged end 62. Slot 60 and its enlarged end 62 permits shroud runner means 46 to flex outwardly for ease in mounting shroud runner means 46 onto a shroud 64 as seen in the views of FIGS. 1 and 2. Finally, shroud runner means 46 further comprises a line aperture 66 formed through body 48 in transverse, intersecting relation to slot 60. For the sake of completeness, it should also be noted that entry of shroud 64 into cavity 50 and interior 56 of tubular segments 54 is restricted by wedges 68 in similar fashion to wedges 26 of pennant clip means 20.

Referring then to the FIG. 1, it can be seen that a pair of shroud runner means 46 have been operatively mounted onto a shroud 64. A pennant line 70 is shown with one end of pennant line 70 operatively connected to shroud runner means 46 through line aperture 66. The view of FIG. 2 illustrates an operative, mating relation between corresponding pennant clip means 20 and shroud runner means 46. In this position, pennant line 70 may be manipulated to either raise or lower flag 36 along shroud 64 as indicated by directional arrows B. Furthermore, because the outside diameter of tubular segments 54 and lips 58 is less than the corresponding inside diameter of lip receivers 42 and enlarged slots 44, both the flag 36 and its associated clip means 20 are free to pivot, or rotate, around shroud 64 so as to prevent any tangling of flag 36 therearound.

In the view of FIG. 9 yet another embodiment of the pennant support of this invention is disclosed as further comprising a halyard runner means generally indicated as 72 movably disposed in substantially surrounding relation on a segment of the support element which may comprise, for example, a halyard 74. This embodiment of halyard runner means 74 comprises an elongated hollow body 76 having a shoulder 78 formed at each end thereof. As shown in phantom in the view of FIG. 9, halyard 74 extends through the elongated hollow body 76 and each of the shoulders 78, and the exterior of elongated hollow body 76 is dimensioned and configured for releasable mating engagement with groove 22 of the pennant clip means 20. The inside diameter of hollow body 76 is greater than the outside diameter of halyard 74 to permit movement of halyard runner means 72 therealong. The outside diameter of hollow body 76 is slightly less than the inside diameter of groove 22 to permit pivoting of clip means 20 with respect to halyard runner means 72, thus preventing any substantial likelihood that any pennant attached to clip means 20 would become tangled around halyard 74. Movement of halyard runner means along halyard 74 would be accomplished by attaching a pennant line (not shown) through one of the line apertures 80 formed through each of the shoulders 78. Operation of this embodiment would be substantially the same as that already described above with regard to the shroud runner means 46/pennant clip means 20 combination of FIG. 2.

The views of FIGS. 10, 11 and 12 illustrate a second embodiment for the halyard runner means 72. Insofar as structural elements are corresponding, similar reference numerals have been utilized for their identification. In this embodiment, the halyard runner means 72 comprises mating first and second halves generally indicated as 82 and 84, respectively. The halves 82 and 84 are releasably attachable to each other along a plane contiguous with the longitudinal axis of hollow body 76 and the shoulder 78 formed thereon. Attachment may be accomplished as by pins 86 and corresponding apertures 88, both of which may be seen in the exploded view of FIG. 10. FIGS. 10, 11 and 12 further depict the hollow interior 90 by virtue of which halyard runner means 72 may move along halyard 74.

At this point it should be noted that while the view of FIG. 10 shows first half 82 as having two pins 86 formed thereon and second half 84 having two apertures formed therein, for ease in fabrication and interchangability of parts, it is contemplated that a single pin 86 and an opposed aperture 88 may be formed on each of the halves 82 and 84.

Still with regard to the views of FIGS. 10, 11 and 12, it can be seen that this halyard runner means 72 further comprises a circumferential groove 92 formed around the perimeter of each of the shoulders 78 in intersecting relation to substantially U-shaped line apertures 94. As best seen in the view of FIG. 11, movement of this halyard runner means 72 along halyard 74 may be accomplished by the action of pennant line 96, a free end of which may be connected to halyard runner means 72 by folding the free end through one of the U-shaped line apertures 94 and disposing therearound within circumferential groove 92 a fastening means such as, for example, strap fastener 98. While an end of pennant line 96 is shown as being operatively attached to each end of halyard runner means 72 in the view of FIG. 11, this is for illustration purposes only. In an operative installation, the connection of pennant line 96 to halyard runner means 72 would be singular as is illustrated with regard to the shroud runner means 46 in FIG. 2. However, a separate line would be connected between the two adjacent halyard runner means 72 in order to prevent parting of the pennant line 96 when the flag was removed. This separate line would preferably be slightly shorter than the distance between the adjacent clip means 20 so that any strain of raising and lowering the flag would be carried by that line. It should also be noted that this mating half construction of runner means 72 is provided so that the runner means 72 may be attached around virtually any line or cable even though no free end is available.

The views of FIGS. 13 and 14 illustrate a further embodiment for the pennant clip means of this invention. Accordingly, reference numeral 20' has been utilized for generally designating the pennant clip means and elements corresponding to those by similar reference numerals with the addition of a prime mark. The primary differences between pennant clip means 20' and that already described with respect to the views of FIGS. 6, 7 and 8 resides in the providing of a pennant line aperture 100 through clip means 20' in substantially parallel relation to the support receiving means comprising elongated groove 22'. Clip means 20' further comprises a substantially circular guide surface 102 intersecting pennant line aperture 100 and at least a portion of the second side 30' of clip means 20'. Furthermore, clip means 20' is formed from two halves, with the halves being held together as by a screw 104. A recess 106 may be formed in the side of one half of clip means 20' in which screw head 108 may be seated. A corresponding recess 110 may be formed in the other half of clip means 20' to receive nut 112. Finally, an auxiliary aperture 114 is provided.

When using the embodiment of clip means 20', guide surface 102 functions as a fixed pulley. The clip means 20' is fixedly attached to a support element (not shown), and the pennant is connected to a pennant line which line is then passed through pennant line aperture 100 over guide surface 102. The pennant may then be raised and lowered. In the preceding description the phrase "fixedly attached" with regard to the relationship between clip means 20' and the support element is simply meant to convey that it is not intended that clip means 20' would move with regard to the longitudinal dimension of the support element.

This "fixed" attachment is accomplished by mounting clip means 20' on the support element and tightening screw 104 as best seen in the view of FIG. 13. Alternatively, this clip means 20' may be used in substantially identical fashion to that of clip means 20 shown in FIGS. 6, 7 and 8. Screw 104 is removed from its aperture and moved to auxiliary aperture 114 for mounting a strap means 28' as indicated in phantom in the view of FIG. 14. In this configuration, clip means 20' would be removably attached to a support element and a flag (not shown) would be connected to strap means 28'.

It should also be noted that when either clip means 20' or clip means 20 is used without a shroud runner 46 or a halyard runner 72 it will be necessary to dispose a stop means (not shown) on the pennant line between adjacent clip means 20 or 20' in order to maintain a space therebetween so that the flag attached thereto is visibly displayed. The stop means may comprise, for example, a few turns of tape around the pennant line just below the top clip means and just above the bottom clip means.

It will thus be seen that the objects set forth above, among those made apparent in the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A pennant support of the type primarily intended for removably connecting a pennant to an elongated support element, said pennant support comprising: a pennant clip means comprising support receiving means formed on a first side thereof whereby said clip means may be removably connected to the support element, said support receiving means comprising an elongated arcuate groove formed along said first side of said clip means, the inside diameter of said groove being dimensioned and configured to snap around at least a portion of the support element; and pennant connecting means disposed on a second side of said clip means whereby a pennant may be connected to said clip means, said pennant connecting means comprising a pennant line aperture formed through said clip means in substantially parallel relation to said groove and a circular guide surface intersecting said pennant line aperture and at least a portion of said second side of said clip means, whereby a pennant line connected to the pennant may be passed through said pennant line aperture and around at least a portion of said guide surface to permit raising and lowering of the pennant with respect to said clip means.

2. A pennant support as in claim 1 wherein said pennant connecting means further comprises a strap means movably attached to the second side of said clip means, said strap means being attached by a fastening means whereby a closed loop is defined for connecting the pennant to said clip means.

3. A pennant support as in claim 1 further comprising halyard runner means movably disposed in substantially surrounding relation on a segment of the support element, said halyard runner means comprising an elongated hollow body having a shoulder formed at each end thereof, said support element extending through said hollow body and said shoulders, said hollow body being dimensioned and configured for releasable mating engagement with said groove formed along the first side of said clip means.

4. A pennant support as in claim 3 wherein said halyard runner means further comprises a line aperture formed through said of said shoulders, whereby a line may be attached to at least one of said shoulders to raise and lower said halyard runner along the support element.

5. A pennant support as in claim 4 wherein the inside diameter of said hollow body is greater than the diameter of the support element to permit movement of said halyard runner means along the support element, and wherein the outside diameter of said hollow body is less than the inside diameter of said groove to permit pivoting of said clip means with respect to said halyard runner means.

6. A pennant support as in claim 5 wherein said halyard runner means comprises first and second mating halves releasably attachable to each other along a plane continguous with the longitudinal axis of said hollow body and said shoulders formed thereon.

7. A pennant support as in claim 6 wherein said halyard runner means further comprises a circumferential groove formed around the perimeter of each of said shoulders in intersecting relation to said line aperture, and a fastening means disposed in at least one of said grooves whereby the line may be secured to at least one of said shoulders.

8. A pennant support as in claim 1 further comprising shroud runner means movably disposed in at least partially surrounding relation on a segment of the support element, said shroud runner means comprising a body having an elongated concavity formed along a first side thereof, a tubular segment congruent with said concavity extending from each end thereof, and an outwardly extending transverse lip formed on the distal end of each of said tubular segments, whereby said shroud runner means may be removably connected to the support element; said elongated groove further comprising a lip receiver integrally formed at each end thereof in receiving relation to one of said lips for releasable mating engagement between said shroud runner means and said clip means.

9. A pennant support as in claim 8 wherein said shroud runner means further comprises a line aperture formed through said body, whereby a line may be attached thereto to raise and lower said shroud runner along the support element.

10. A pennant support as in claim 9 wherein said shroud runner means further comprises a slot formed through said body in substantially transverse relation to said line aperture and in intersecting relation to both said concavity and said line aperture, whereby said shroud runner may be more easily connected to the support element.

11. A pennant support as in claim 10 wherein said shroud runner means further comprises an enlarged end of said slot opposite from said concavity.

12. A pennant support as in claim 10 wherein the inside diameter of said concavity and of each of said tubular segments is greater than the diameter of the support element to permit movement of said shroud runner means along the support element, and wherein the outside diameters of both said tubular segments and said lips are less than the inside diameter of said lip receivers to permit pivoting of said clip means with respect to said shroud runner means.

* * * * *

UNITED STATES PATENT AND TRADEMARK OFFICE

CERTIFICATE OF CORRECTION

PATENT NO. : 4,474,132

DATED : October 2, 1984

INVENTOR(S) : Robert C. Fritsch

It is certified that error appears in the above-identified patent and that said Letters Patent are hereby corrected as shown below:

Column 8, line 49, delete the first occurrence of the word "said" and insert therefor -- each --.

Signed and Sealed this

*Fifth* Day of *March 1985*

[SEAL]

*Attest:*

DONALD J. QUIGG

*Attesting Officer* *Acting Commissioner of Patents and Trademarks*